US007523570B2

(12) United States Patent
Pobihushchy

(10) Patent No.: US 7,523,570 B2
(45) Date of Patent: Apr. 28, 2009

(54) VACUUM TRUCK SOLIDS HANDLING APPARATUS

(75) Inventor: Victor Pobihushchy, Red Deer (CA)

(73) Assignee: Non Stop Hydro Excavation Ltd., Red Deer County, Alberta (CA)

( * ) Notice: Subject to any disclaimer, the term of this patent is extended or adjusted under 35 U.S.C. 154(b) by 94 days.

(21) Appl. No.: 10/966,430

(22) Filed: Oct. 15, 2004

(65) Prior Publication Data

US 2006/0123745 A1 Jun. 15, 2006

(30) Foreign Application Priority Data

Aug. 16, 2004 (CA) ..... 2479443

(51) Int. Cl.
*E02F 3/94* (2006.01)

(52) U.S. Cl. ..... 37/318; 175/67; 209/12.1

(58) Field of Classification Search ..... 37/317, 37/318, 320; 175/67; 209/12.1, 246, 250
See application file for complete search history.

(56) References Cited

U.S. PATENT DOCUMENTS

| | | | | |
|---|---|---|---|---|
| 2,919,898 | A | 1/1960 | Marwil et al | |
| 3,890,229 | A | 6/1975 | Eder | |
| 3,899,414 | A | 8/1975 | Hansen | |
| 4,128,474 | A | 12/1978 | Ennis | |
| 4,227,997 | A * | 10/1980 | Shaddock | 209/250 |
| 4,282,088 | A | 8/1981 | Ennis | |
| 4,290,820 | A * | 9/1981 | Swisher et al | 134/6 |
| 4,325,819 | A | 4/1982 | Altizer | |
| 4,341,352 | A | 7/1982 | Liller | |
| 4,378,290 | A | 3/1983 | Kennedy, Jr. | |
| 4,459,207 | A | 7/1984 | Young | |
| 4,571,296 | A | 2/1986 | Lott | |
| 4,615,129 | A * | 10/1986 | Jackson | 37/197 |
| 4,854,058 | A | 8/1989 | Sloan et al. | |
| 4,936,031 | A | 6/1990 | Briggs et al. | |
| 4,938,864 | A | 7/1990 | Frazier et al. | |
| 5,016,717 | A | 5/1991 | Simons et al. | |
| 5,083,386 | A | 1/1992 | Sloan | |
| 5,109,933 | A | 5/1992 | Jackson | |
| 5,129,468 | A | 7/1992 | Parmenter | |
| 5,129,469 | A | 7/1992 | Jackson | |
| 5,140,759 | A | 8/1992 | Artzberger | |
| 5,295,317 | A | 3/1994 | Perrott | |
| 5,299,370 | A | 4/1994 | Gyori et al. | |
| 5,344,570 | A | 9/1994 | McLachlan et al. | |

(Continued)

FOREIGN PATENT DOCUMENTS

| | | |
|---|---|---|
| EP | 0 647 483 | 4/1995 |

(Continued)

*Primary Examiner*—Thomas B Will
*Assistant Examiner*—Jamie L McGowan
(74) *Attorney, Agent, or Firm*—Davis & Bujold, P.L.L.C.

(57) ABSTRACT

A vacuum truck solids handling apparatus includes a truck having an internal combustion engine and a truck frame. A vacuum source, a solids collection container and a separator assembly are all mounted on the truck frame. The separator assembly is adapted to separate solids from a fluid stream drawn under vacuum by the vacuum source. The separator assembly has a pivotally mounted discharge, which pivots between a closed discharge position and an open discharge position. In the closed discharge position, the discharge discharges solids into the solids collection container. In the open discharge position, the discharge discharges solids externally.

18 Claims, 4 Drawing Sheets

U.S. PATENT DOCUMENTS

| | | | | |
|---|---|---|---|---|
| 5,348,160 | A | 9/1994 | Kindig | |
| 5,487,229 | A * | 1/1996 | Nathenson et al. | 37/347 |
| 5,582,727 | A | 12/1996 | Foster | |
| 5,599,137 | A | 2/1997 | Stephenson et al. | |
| 5,611,403 | A * | 3/1997 | Theurer et al. | 171/16 |
| 5,643,470 | A | 7/1997 | Amini | |
| 5,671,979 | A * | 9/1997 | Poborsky | 298/17 R |
| 5,794,791 | A | 8/1998 | Kindig | |
| 5,938,936 | A | 8/1999 | Hodges et al. | |
| 5,996,171 | A * | 12/1999 | Bowers | 15/340.1 |
| 6,082,548 | A | 7/2000 | Stephenson et al. | |
| 6,138,834 | A | 10/2000 | Southall | |
| 6,149,811 | A | 11/2000 | Hodges et al. | |
| 6,156,083 | A | 12/2000 | Dial | |
| 6,193,070 | B1 | 2/2001 | Rowney et al. | |
| 6,453,584 | B1 * | 9/2002 | Buckner | 37/323 |
| 6,533,944 | B1 | 3/2003 | Rohr | |
| 6,585,115 | B1 | 7/2003 | Reddoch et al. | |
| 6,599,434 | B2 | 7/2003 | Mullins | |
| RE38,367 | E | 12/2003 | Southall | |
| 6,675,437 | B1 * | 1/2004 | York | 15/321 |
| 6,752,467 | B1 | 6/2004 | Palrose et al. | |
| 6,754,978 | B1 * | 6/2004 | Adams et al. | 34/361 |
| 6,988,568 | B2 * | 1/2006 | Buckner | 175/67 |
| 2003/0226788 | A1 | 12/2003 | Bergeron | |
| 2005/0210623 | A1 * | 9/2005 | Buckner | 15/340.1 |
| 2006/0032095 | A1 * | 2/2006 | Buckner | 37/304 |
| 2006/0101881 | A1 * | 5/2006 | Carin et al. | 71/21 |

FOREIGN PATENT DOCUMENTS

| | | |
|---|---|---|
| JP | 60 115 632 | 6/1985 |
| WO | WO 9 947 280 | 9/1999 |

* cited by examiner

VACUUM TRUCK SOLIDS HANDLING APPARATUS

FIELD OF THE INVENTION

This application claims priority from Canadian Application Serial No. 2479443 filed Aug. 16, 2004.

The present invention relates to a vacuum truck, which has a versatile solids handling apparatus.

BACKGROUND OF THE INVENTION

Vacuum trucks are used for excavation, whenever there are buried objects which might be damaged by mechanical excavation equipment. For example, one would not want to use mechanical excavation equipment to unearth a buried natural gas pipeline.

Vacuum trucks use a stream of fluids, usually air or water, to dislodge earth. A vacuum is then used to draw water with solids from the excavation into a holding tank.

U.S. Pat. No. 5,996,171 (Bowers from 1999) teaches some novel solids handling features on a vacuum truck which uses air. The Bowers reference teaches the use of filters and separators to separate solids from the air. The Bowers reference also teaches the use of a holding tank which is capable of being dumped. As an alternative to dumping, the Bowers reference teaches the use of removable holding tanks. This enables the holding tank to be removed and taken to a dumping site by a transport vehicle, while the vacuum truck continues to operate using a replacement holding tank. Another patent reference which teaches solids separation include U.S. Pat. No. 5,295,317 (Perrott from 1994). Another patent reference which teaches the use of a holding tank which can be dumped is U.S. Pat. No. 6,752,467 (Palrose et al from 2004).

SUMMARY OF THE INVENTION

What is required is a vacuum truck solids handling apparatus which provides further solids handling options.

According to the present invention there is provided a vacuum truck solids handling apparatus which includes a truck having an internal combustion engine and truck frame. A vacuum source, a solids collection container and a separator assembly are all mounted on the truck frame. The separator assembly is adapted to separate solids from a fluid stream drawn under vacuum by the vacuum source. The separator assembly has a pivotally mounted discharge, which pivots between a closed discharge position and an open discharge position. In the closed discharge position, the discharge discharges solids into the solids collection container. In the open discharge position, the discharge discharges solids externally.

The vacuum truck solids handling apparatus, as described above, provides for maximum flexibility. When the discharge is in the open position, solids may be loaded into a transport truck or, when permissible, discharged on site. There remains the capability to operate, as required, with the discharge in the closed discharge position. In the preferred embodiment, these features are combined with an ability to dump the solids collection container and additional features which enable superior solids separation.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
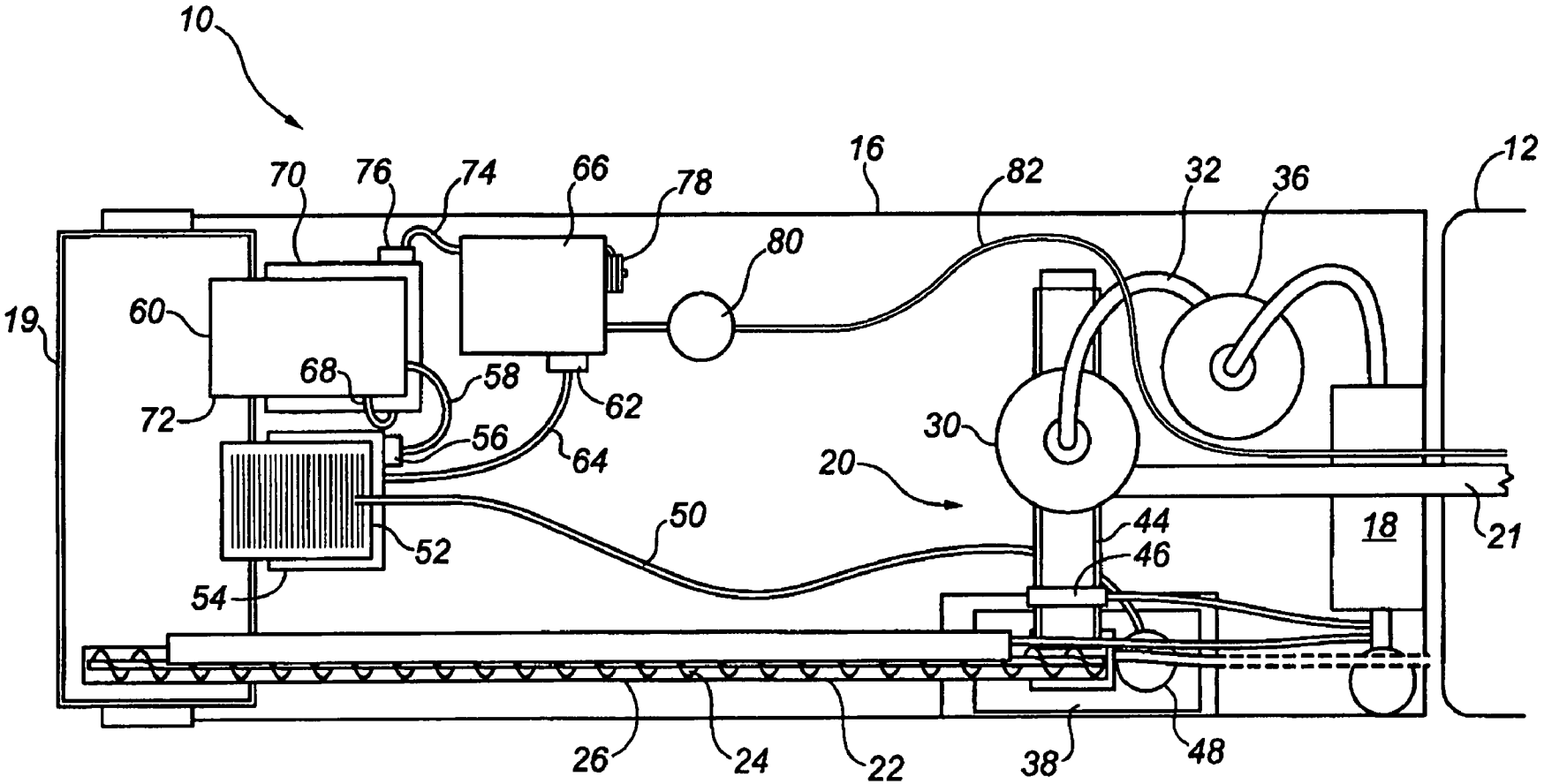
FIG. 1 is a top plan view of the vacuum truck solids handling apparatus constructed in accordance with the present invention.

The preferred embodiment, a vacuum truck solids handling apparatus generally identified by reference numeral 10, will now be described with reference to FIGS. 1 through 4.

Figure 2:
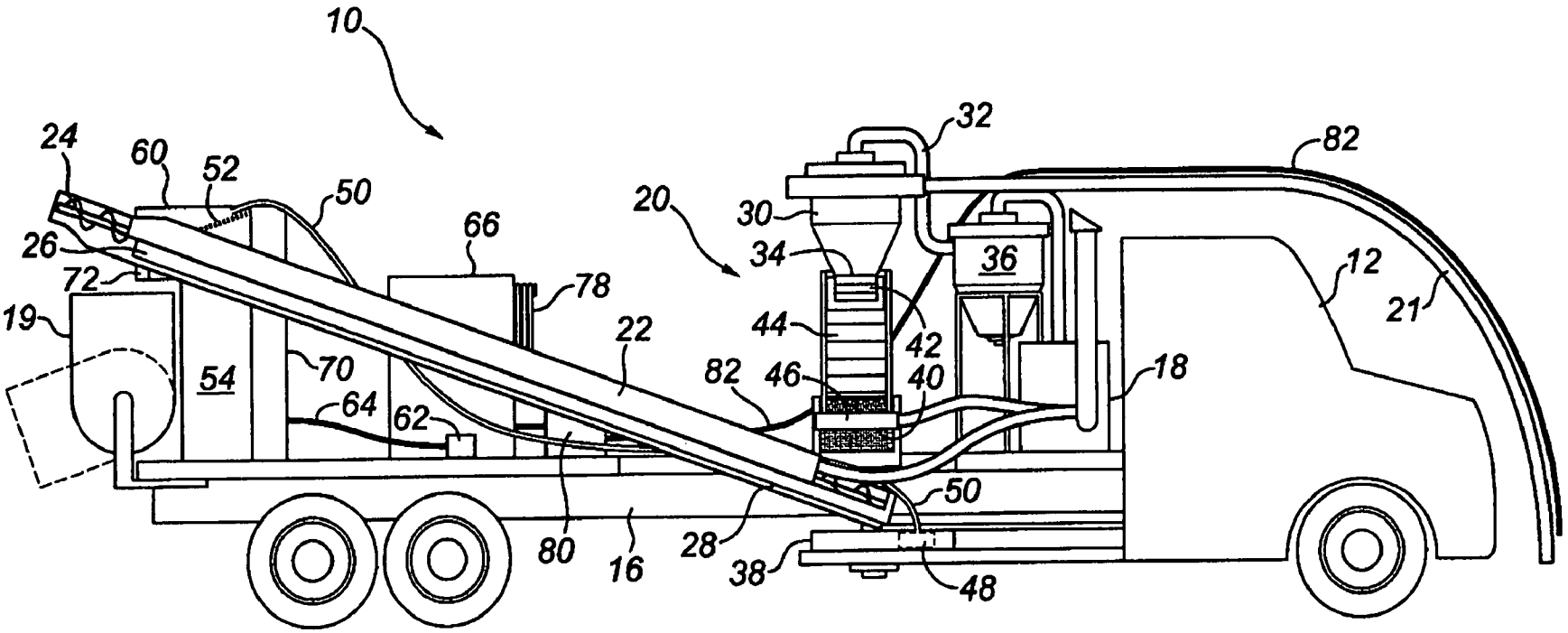
FIG. 2 is a side elevation view of the vacuum truck solids handling apparatus of FIG. 1.

Structure and Relationship of Parts:

Referring now to FIG. 2, there is shown a vacuum truck solids handling apparatus 10, comprising a truck 12 having an internal combustion engine (not shown) and truck frame 16. A vacuum source 18 is mounted on truck frame 16. A solids collection container 19 is pivotally mounted on truck frame 16 for pivotal movement between an operative position and a dumping position. A separator assembly 20 is mounted on truck frame 16, where separator assembly 20 is adapted to separate solids from a fluid stream of air, water and solids drawn under vacuum by vacuum source 18 through vacuum hose 21. Separator assembly 20 also has a pivotally mounted discharge 22 which pivots between a closed discharge position shown in FIG. 1 and an open discharge position shown in FIG. 4. Referring to FIG. 1, in the closed discharge position, the discharge 22 discharges solids into solids collection container 19, and, referring to FIG. 4, in the open discharge position, discharge 22 discharges solids externally. For example, the open discharge position may be used to fill a standby truck to haul away the excavated solids such that vacuum truck solids handling apparatus 10 is able to stay on site and continue working while the solids are being hauled away, or it may be used to create a pile of excavated solids on the ground.

Referring again to FIG. 1, an auger 24 is positioned in discharge 22 of separator assembly 20 and has an auger bed 26. Auger bed 26 has fluid flow passages 28, such that hot fluids that are heated either directly or indirectly by internal combustion engine 14 flows through fluid flow passages 28 to heat auger bed 26 to dry solids carried by auger 24 along auger bed 26, and hot exhaust gases that are generated by internal combustion engine 14 flow along discharge 22 of separator assembly 20 to dry solids carried by auger 24 along auger bed 26. It is important to avoid contact between the exhaust from internal combustion engine 14 and the solids that are carried by auger 24 to prevent contamination.

Figure 3:
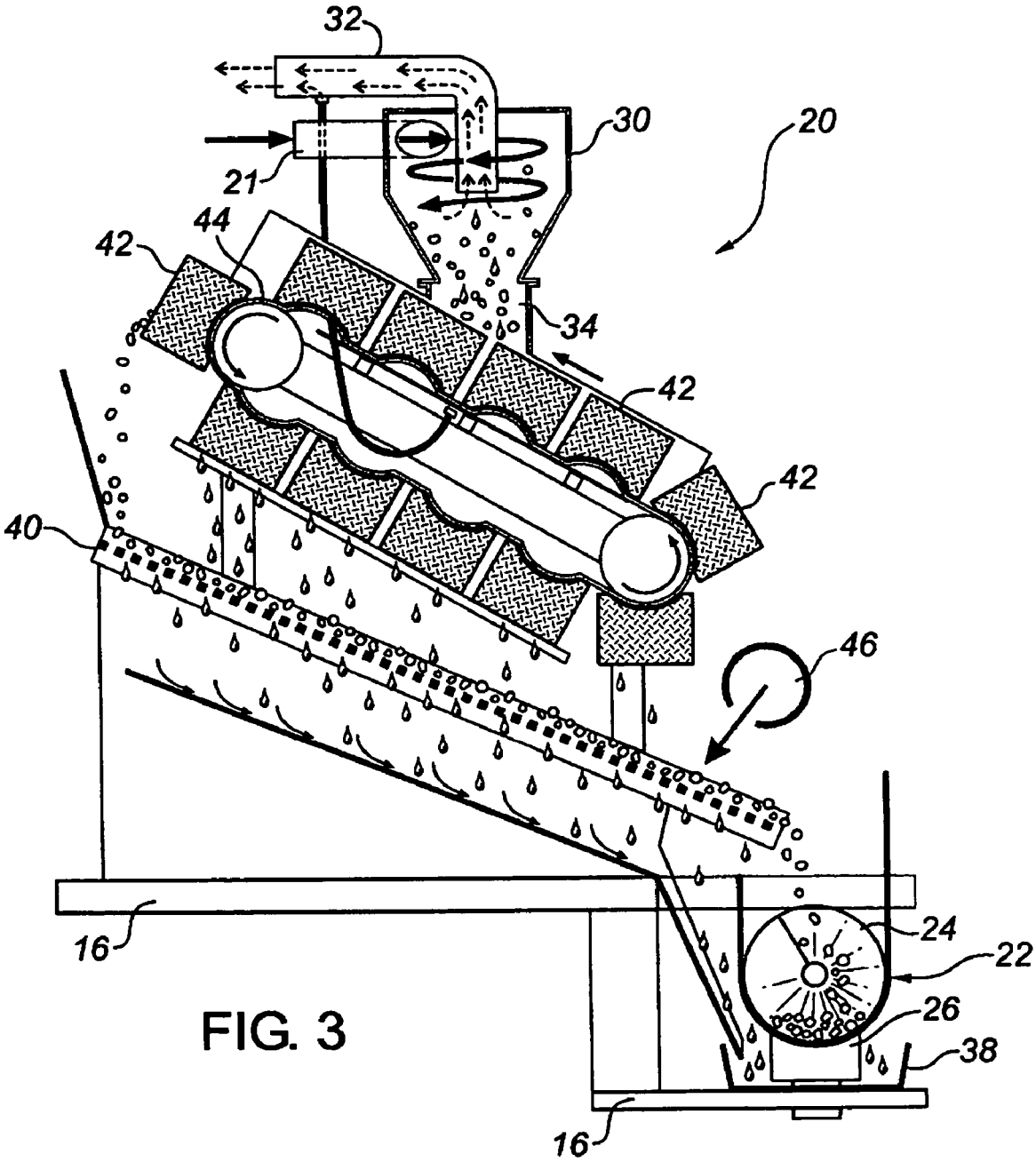
FIG. 3 is a detailed side elevation view of the separator assembly.

Referring now to FIG. 3, separator assembly 20 includes a cyclone separation chamber 30 that is adapted to receive an incoming fluid stream of air, water and solids from vacuum hose 21 and separate the incoming fluid stream into a first outgoing stream of air in air conduit 32 and a second outgoing stream of solids mixed with water through exit 34. Referring to FIG. 1, the first outgoing stream of air exiting cyclone separation chamber 30 through air conduit 32 may be passed through a secondary cyclone separator 36 for further cleaning. Air conduit 32 is then connected to vacuum source 18, which provides the necessary vacuum pressure. Referring again to FIG. 3, a water catch basin 38 is in fluid communication with the second outgoing stream of cyclone separation chamber 30 to capture water obtained from the separation process. A solids screen 40 is positioned between the second outgoing stream through exit 34 of cyclone separation chamber 30 and water catch basin 38 to separate solids in the second outgoing stream from water. The second outgoing stream from exit 34 is deposited onto the solids screen by a plurality of baskets 42. Baskets 42 are loaded with the solid and liquid mixture as they pass under exit 34 of cyclone separation chamber 30. To maintain vacuum pressure through vacuum hose 21, exit 34 forms an airtight seal with baskets 42. A conveyor 44 carries baskets 42 sequentially to a solids dumping position underneath conveyor 44 and then returns to a solids loading position on the top of conveyor 44, such that solids are moved from baskets 42 to the back of solids screen 40. In FIG. 3, conveyor rotates in a counter-clockwise direction. Solids screen 40 is positioned at an angle, where a drive mechanism shakes angled solids screen 40 such that solids migrate down angled solids screen 40 to auger 24 in discharge 22, and also strains the liquids from the solids. Exhaust from vacuum source 18 may also be directed onto angled solids screen 40 through an exhaust vent 46 to encourage separation of water and solids. It will be understood that, while FIGS. 1 through 4 shows exhaust from vacuum source 18 directed onto solids screen 40 and exhaust from internal combustion engine 14 is used with respect to auger 24 and auger bed 26, the connections may be modified in any reasonable configuration that allows hot gas to be used in the separation process.

Referring now to FIG. 1, water which accumulates in water catch basin 38 is pumped through a variety of filters for further cleaning prior to being reused, which will now be discussed. Water is first pumped by pump 48 through water line 50 to a second vibrating screen 52. Solids that are obtained from second vibrating screen 52 are deposited in solids collection container 19. The water from second vibrating screen 52 falls into a second catch basin 54, and is pumped by pump 56 through line 58 into a centrifuge 60. Because centrifuge 60 requires a constant water level, water may be pumped by pump 62 through line 64 into second catch basin 54 from a water tank, or second water tank 66 as shown, to supply water if the supply from water catch basin 38 were to stop or diminish significantly. In addition, provision may be made to introduce a chemical additive, for example into second catch basin 54 or where deemed necessary, to help separate the solids from the liquids. A float or other means may be included (not shown) to activate pump 62 or to indicate when the water level is low. The cleaned water exits centrifuge 60 through line 68 into water tank 70, and solids obtained from the process exit deposit end 72 into solids collection container 19. While not required, it may be preferable to have second water tank 66 that is fed through water line 74 by pump 76 on water tank 70. Second water tank 66 then acts as the source of water for other operations on truck 12, such as a water hose 78 for cleaning truck 12, equipment, or to be used for other purposes. A pump 80 is included and connected to a high pressure hose 82 which is used as the source of water in the excavation process. As described, vacuum truck solids handling apparatus 10 uses components to actively separate the solids and liquids, such as centrifuge 60 and exhaust vent 46 which blows hot exhaust onto angled screen 40, which provides a much more efficient method than the common practice of settling solids out of the liquid.

If vacuum source 18 is driven by internal combustion engine 14, another power source, such as a smaller motor, may be required to run the other portions of apparatus 10, such as pumps 48, 56, 62, 76, centrifuge 60, and conveyor 44.

Figure 4:
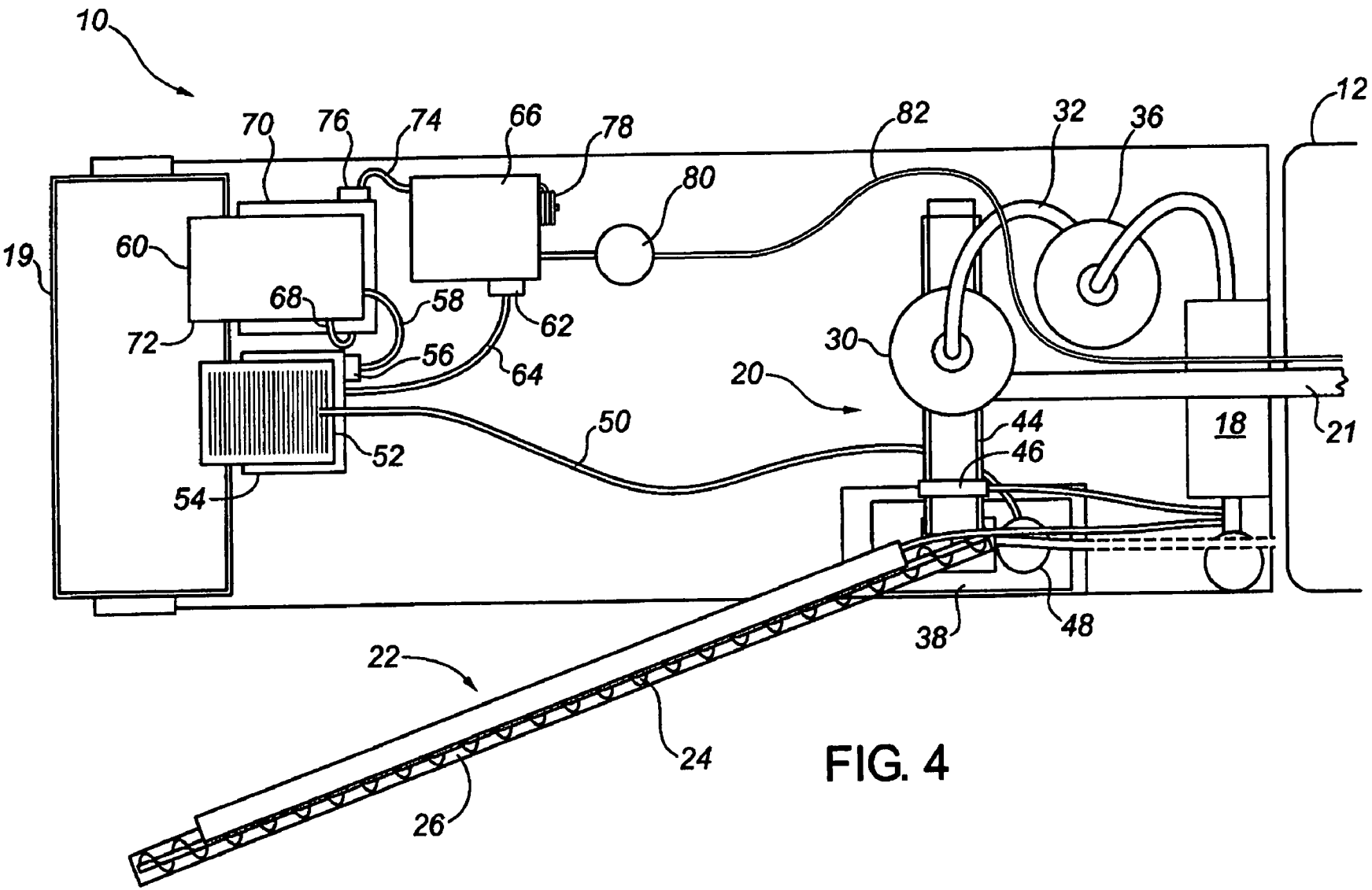
FIG. 4 is a side elevation view of the vacuum truck solids handling apparatus of FIG. 1 with the discharge in the open discharge position.

Operation:

The use and operation of vacuum truck solids handling apparatus 10 will now be discussed with reference to FIGS. 1 through 4. Referring now to FIG. 1, water from second water tank 66 is sprayed by pump 80 through high pressure hose 82 onto the excavation site to create a slurry of water and solids. The slurry and air are drawn under pressure by vacuum source 18 through vacuum hose 21 to separator assembly 20. The fluid stream of air, water, and solids enters cyclone separation chamber 30, where air exits through air conduit 32. Air conduit 32 leads the air from cyclone separation chamber 30 to secondary cyclone separation chamber 36, and then leads back to vacuum source 18. Referring to FIG. 3, the water and solid stream of fluid in cyclone separation chamber 30 is deposited out exit 34 into baskets 42 on conveyor 44. To maintain adequate pressure through vacuum hose 21, baskets 42 and exit 34 form an airtight seal. Conveyor 44 moves baskets 42 from a solids loading position to a dumping position, such that the mixture is dumped onto solids screen 40. Solids screen 40 allows liquid to fall through into catch basin 38, while solids are kept on the top and deposited into auger 24. Solids screen 40 may be referred to as a vibrating screen, as a drive mechanism 41 shakes solids screen 40. This improves the separation of water and solids, as well as encourages the mixture to move down screen 40 toward auger 24 and auger bed 26. At the end of screen 40, in auger 24 and in auger bed 26, hot exhaust from either internal combustion engine 14 or vacuum source 18 is used to help either dry the solids mixture by heating, or help separate the water from the solids mixture by blowing. As solids mixture from solids screen 40 travels up the auger, water is separated out and runs down into water catch basin 38, while hot exhaust is heating auger bed 26 and blowing down onto the solids mixture. The exhaust is blown into auger 24 opposite the direction of rotation of auger 24, such that, as the mixture is raised on one side, it meets hot exhaust being blown onto it. At the end of auger 24, the processed mixture is deposited either in solids collection container 19 if discharge 22 is in the closed position as shown in FIG. 1, or in an external location, for example a separate truck or pile if discharge 22 is in the open position as shown in FIG. 4. Returning to catch basin 38, pump 48 pumps the collected water through water line 50 to second vibrating screen 52, where solids from the top of screen 52 are deposited into solids collection container 19, and water falls into second catch basin 54. Water is pumped from the bottom of second catch basin 54 by pump 56 through line 58 into centrifuge 60, where further separation occurs. The cleaned water is moved to water tank 70 through line 68, and solids obtained are deposited into solids collection container 19. Second water tank 66 receives water from water tank 70 by pump 76 through water line 74. Since centrifuge 60 requires a constant supply of water, pump 62 pumps water from second water tank 66 into second catch basin 54 as needed. The water in second water tank 66 is also used to clean equipment using water hose 78 and to supply pump 80 and high pressure hose 82 with water.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A vacuum truck solids handling apparatus, comprising:

a truck having an internal combustion engine and truck frame;

a vacuum source mounted on the truck frame;

a solids collection container mounted on the truck frame;

a separator assembly mounted on the truck frame, the separator assembly being adapted to separate solids from a fluid stream drawn under vacuum by the vacuum source, the separator assembly comprising:

a cyclone separation chamber adapted to receive an incoming fluid stream of air, fluid and solids and separate the incoming fluid stream into a first outgoing stream of air and a second outgoing stream of solids mixed with fluid, the second outgoing stream being discharged through an airlock exit for further treatment at atmospheric pressure;

a solids screen positioned outside of the vacuum to separate solids in the second outgoing stream from the fluid, the at least one solids scene is positioned at an angle; and exhaust from the vacuum source is directed onto the angled solids screen;

means to transport the second outgoing stream from the airlock exit to the solids screen;

a pivotally mounted discharge which pivots between a closed discharge position and an open discharge position, in the closed discharged position the discharge discharging solids into the solids collection container in the open discharge position the discharge discharging solids externally; and means for moving solids from the solids screen to the discharge.

2. The vacuum truck solids handling apparatus as defined in claim 1, wherein the means for moving solids from the solid screen to the discharge further comprise a drive mechanism that shakes the angled screen, causing solids to migrate down the angled solids screen to the auger in the discharge.

3. A vacuum truck solids handling apparatus, comprising:

a truck having an internal combustion engine and truck frame;

a vacuum source mounted on the truck frame;

a solids collection container mounted on the truck frame;

a separator assembly mounted on the truck frame, the separator assembly being adapted to separate solids from a fluid stream drawn under vacuum by the vacuum source, the separator assembly comprising:

a cyclone separation chamber adapted to receive an incoming fluid stream of air, fluid and solids and separate the incoming fluid stream into a first outgoing stream of air and a second outgoing stream of solids mixed with fluid, the second outgoing stream being discharged through an airlock exit for further treatment at atmospheric pressure;

a solids screen positioned outside of the vacuum to separate solids in the second outgoing stream from the fluid;

a plurality of baskets and a conveyor that carries the baskets sequentially from the airlock exit of the cyclone separation chamber to a solids dumping position over the solids screen and then returns the baskets sequentially to a solids loading position;

a pivotally mounted discharge which pivots between a closed discharge position and an open discharge position, in the closed discharge position the discharge discharging solids into the solids collection container and in the open discharge position the discharge discharging solids externally; and means for moving solids from the solids screen to the discharge.

4. The vacuum truck solids handling apparatus as defined in claim 1, wherein the solids collection container is pivotally mounted for pivotal movement between an operative position and a dumping position.

5. The vacuum truck solids handling apparatus as defined in claim 1, wherein the fluid stream drawn under vacuum is water and an auger having an auger bed is positioned in the discharge from the separator assembly.

6. The vacuum truck solids handling apparatus as defined in claim 5, wherein the auger bed has fluid flow passages and hot fluids heated either directly or indirectly by the internal combustion engine flow through the fluid flow passages to heat the auger bed to dry solids carried by the auger along the auger bed.

7. The vacuum truck solids handling apparatus as defined in claim 5, wherein hot exhaust gases generated by the internal combustion engine flow along the discharge of the separator assembly to dry solids carried by the auger along the auger bed.

8. The vacuum truck solids handling apparatus as defined in claim 1, wherein the separator assembly further comprises:

a fluid catch basin in fluid communication with the second outgoing stream of the cyclone separation chamber to capture water.

9. The vacuum truck solids handling apparatus as defined in claim 1, wherein the at least one solids screen is positioned at an angle, the means for moving solids down the angled solids screen being a drive mechanism shakes the angled solids screen causing solids to migrate down the angled solids screen to the auger in the discharge.

10. The vacuum truck solids handling apparatus as defined in claim 1, wherein the first outgoing stream of air existing the cyclone separation chamber is passed through a secondary cyclone separator for further cleaning.

11. The vacuum truck solids handling apparatus as defined in claim 1, wherein water which accumulates in the water catch basin is pumped through at least one of filters and a centrifuge for further cleaning prior to being reused.

12. The vacuum truck solids handling apparatus as defined in claim 1 wherein the pivotally mounted discharge in the open discharge position is adapted to discharge solids onto a pile or into a truck.

13. A vacuum truck solids handling apparatus, comprising:

a truck having an internal combustion engine and truck frame;

a vacuum source mounted on the truck frame;

a solids collection container pivotally mounted on the truck frame for pivotal movement between an operative position and a dumping position:

a separator assembly mounted on the truck frame, the separator assembly being adapted to separate solids from a fluid stream of air, water and solids drawn under vacuum by the vacuum source, the separator assembly having a pivotally mounted discharge which pivots between a closed discharge position and an open discharge position, in the closed discharge position the discharge discharging solids into the solids collection container and in the open discharge position the discharge discharging solids externally;

an auger having an auger bed, the auger being positioned in the discharge from the separator assembly, the auger bed having fluid flow passages, hot fluids heated either directly or indirectly by the internal combustion engine flowing through the fluid flow passages to heat the auger bed to dry solids carried by the auger along the auger bed, hot exhaust gases generated by the internal combustion engine flowing along the discharge of the separator assembly to dry solids carded by the auger along the auger bed;

the separator assembly including:

a cyclone separation chamber adapted to receive an incoming fluid stream of air, water and solids and separate the incoming fluid stream into a first outgoing stream of air and a second outgoing stream of solids mixed with water, the second outgoing stream being discharged through an airlock exit for further treatment at atmospheric pressure;

a water catch basin positioned outside of the vacuum to capture water;

at least one solids screen positioned outside of the vacuum between the second outgoing stream of the cyclone separation chamber and the water catch basin to separate solids in the second outgoing stream from water;

a plurality of baskets and a conveyor which carries the baskets sequentially from the airlock exit of the cyclone separation chamber to a solids dumping position over the solids screen and then returns the baskets sequential to a solids loading position; and means for moving solids from the at least one solids screen to the auger in the discharge.

14. The vacuum truck solids handling apparatus as defined in claim 13, wherein the at least one solids screen is positioned at an angle, the means for moving solids down the angled solids screen being a drive mechanism shakes the angled solids screen causing solids to migrate down the angled solids screen to the auger in the discharge.

15. The vacuum truck solids handling apparatus as defined in claim 13, wherein the first outgoing stream of air exiting the cyclone separation chamber is passed through a secondary cyclone separator for further cleaning.

16. The vacuum truck solids handling apparatus as defined in claim 13, wherein water which accumulates in the water catch basin is pumped through filters for further cleaning prior to being reused.

17. The vacuum truck solids handling apparatus as defined in claim 14, wherein exhaust from the vacuum source is directed onto the angled solids screen.

18. The vacuum truck solids handling apparatus as defined in claim 13 wherein the pivotally mounted discharge in the open discharge position discharges solids onto a pile or into a truck.

* * * * *